US008902207B2

(12) United States Patent
Ryu et al.

(10) Patent No.: US 8,902,207 B2
(45) Date of Patent: Dec. 2, 2014

(54) ORGANIC LIGHT EMITTING DISPLAY WITH BRIGHTNESS CONTROL AND METHOD OF DRIVING THE SAME

(75) Inventors: Do-Hyung Ryu, Yongin (KR); Keum-Nam Kim, Yongin (KR); Sang-Moo Choi, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 992 days.

(21) Appl. No.: 12/801,011

(22) Filed: May 17, 2010

(65) Prior Publication Data

US 2011/0057917 A1 Mar. 10, 2011

(30) Foreign Application Priority Data

Sep. 7, 2009 (KR) ..... 10-2009-0083930

(51) Int. Cl.
*G09G 3/32* (2006.01)

(52) U.S. Cl.
CPC ..... *G09G 3/3266* (2013.01); *G09G 3/3291* (2013.01); *G09G 2360/02* (2013.01); *G09G 2300/0861* (2013.01); *G09G 2330/021* (2013.01); *G09G 2300/0842* (2013.01); *G09G 2340/0435* (2013.01); *G09G 2320/0233* (2013.01); *G09G 2310/0262* (2013.01); *G09G 3/3233* (2013.01); *G09G 2320/103* (2013.01)
USPC ..... 345/211; 345/76; 345/102; 345/212

(58) Field of Classification Search
CPC ..... G09G 3/3208; G09G 3/32; G09G 3/3225
USPC ..... 345/45–46, 76–84, 87–100, 204, 345/211–212; 348/739
See application file for complete search history.

(56) References Cited

U.S. PATENT DOCUMENTS

2003/0020699 A1* 1/2003 Nakatani et al. ..... 345/204
2006/0267972 A1* 11/2006 Yi ..... 345/211

(Continued)

FOREIGN PATENT DOCUMENTS

CN 1945387 A 4/2007
CN 101496089 A 7/2009

(Continued)

OTHER PUBLICATIONS

Japanese Office action for corresponding JP application 2009-270594, dated Jun. 5, 2012, Do-Hyung Ryu, et al.

(Continued)

*Primary Examiner* — Jonathan Boyd
*Assistant Examiner* — James Nokham
(74) *Attorney, Agent, or Firm* — Lee & Morse, P.C.

(57) ABSTRACT

An organic light emitting display includes a mode determining unit adapted to determine whether the display is in a low power or common driving mode based on an operation control signal and to generate a control signal corresponding to the determined mode, a scan driver adapted to sequentially supply scan signals to scan lines, a data driver adapted to supply data signals to data lines in synchronization with the scan signals, pixels arranged at intersections of the scan lines and the data lines, and a timing controller adapted to control the scan driver and the data driver so that a frame frequency changes based on whether the low power driving mode or the common driving mode control signal is supplied from the mode determining unit, wherein the scan driver is adapted to uniformly maintain a pulse width of the scan signals regardless of a change in the frame frequency.

23 Claims, 3 Drawing Sheets

(56) References Cited

U.S. PATENT DOCUMENTS

| | | | | |
|---|---|---|---|---|
| 2007/0063991 | A1 | 3/2007 | Lee et al. | |
| 2007/0152945 | A1 | 7/2007 | Park et al. | |
| 2008/0036704 | A1* | 2/2008 | Kim et al. | 345/76 |
| 2008/0055289 | A1* | 3/2008 | Kim et al. | 345/204 |
| 2009/0185082 | A1* | 7/2009 | Hashimoto | 348/739 |
| 2009/0219236 | A1 | 9/2009 | Lee et al. | |
| 2009/0237391 | A1 | 9/2009 | Yanagi et al. | |
| 2009/0244112 | A1* | 10/2009 | Jung et al. | 345/691 |
| 2009/0295779 | A1 | 12/2009 | Yanagi et al. | |
| 2010/0253671 | A1* | 10/2010 | Perry et al. | 345/212 |

FOREIGN PATENT DOCUMENTS

| | | | |
|---|---|---|---|
| CN | 101501753 | A | 8/2009 |
| EP | 1580721 | A2 | 9/2005 |
| EP | 1840866 | A2 | 10/2007 |
| JP | 11-003063 | A | 1/1999 |
| JP | 2001-296841 | A | 10/2001 |
| JP | 2004-045662 | A | 2/2004 |
| JP | 2005-031630 | A | 2/2005 |
| JP | 2006-084758 | A | 3/2006 |
| JP | 2007-183545 | A | 7/2007 |
| JP | 2007-318193 | A | 12/2007 |
| JP | 2008-197626 | A | 8/2008 |
| KR | 10 2004-0091415 | A | 10/2004 |
| KR | 10-2007-0071496 | A | 7/2007 |
| KR | 10 2007-0106263 | A | 11/2007 |
| KR | 10 2008-0043539 | A | 5/2008 |
| KR | 10 2009-0059384 | A | 6/2009 |

OTHER PUBLICATIONS

Korean Office Action in KR 10-2009-0083930, dated Oct. 27, 2011 (Ryu, et al.).
European Extended Search Report in EP 10175515.5-2205, dated Dec. 15, 2010 (Ryu, et al.).
European Office Action Dated Jan. 22, 2013.
Chinese Office action for corresponding CN application 201010206896.0, dated Jun. 11, 2012, Do-Hyung Ryu, et al.
Chinese Office Action dated Feb. 28, 2013.

* cited by examiner

ORGANIC LIGHT EMITTING DISPLAY WITH BRIGHTNESS CONTROL AND METHOD OF DRIVING THE SAME

BACKGROUND

1. Field

Embodiments relate to an organic light emitting display and a method of driving the same. More particularly, embodiments relate to an organic light emitting display and a method of driving such an organic light emitting display capable of uniformly maintaining brightness and color coordinates so that a user cannot recognize a change in a frame frequency.

2. Description of the Related Art

Recently, various flat panel displays (FPD) that are lower in weight and smaller in volume than comparable cathode ray tubes (CRT) have been developed. FPDs generally include liquid crystal displays (LCD), field emission displays (FED), plasma display panels (PDP), and organic light emitting displays.

Among the FPDs, organic light emitting displays may display images using organic light emitting diodes (OLED) that generate light by the re-combination of electrons and holes. Organic light emitting displays generally have characteristics such as relatively high response speeds and lower power consumption.

In general, organic light emitting displays include pixels arranged in a matrix. Each of the pixels may include at least two transistors and at least one capacitor and organic light emitting diode (OLED).

The pixels may display an image with predetermined brightness by respectively supplying currents corresponding to voltages charged in the capacitors to the OLEDs via driving transistors. The capacitors may be charged with voltages corresponding to data signals, respectively, during a period when scan signals are supplied.

Organic light emitting displays may be adapted to be driving in a common driving mode with a first frame frequency and a low-power driving mode with a second frame frequency that is lower than the first frame frequency. Organic light emitting displays that are adapted to maintain brightness and/or color characteristics irrespective of changes in frame frequency are desired.

SUMMARY

Embodiments are therefore directed to organic light emitting displays and methods of driving such organic light emitting displays, which substantially overcome one or more of the problems due to the limitations and disadvantages of the related art.

It is therefore a feature of an embodiment to provide an organic light emitting display capable of uniformly maintaining brightness and color coordinates so that a user does not recognize a change in a frame frequency.

It is therefore a separate feature of an embodiment to provide a method of driving an organic light emitting display capable of uniformly maintaining brightness and color coordinates so that a user does not recognize a change in a frame frequency.

It is therefore a separate feature of an embodiment to provide an organic light emitting display that supplies scan signals having a same pulse width irrespective of a frame frequency and/or driving mode.

It is therefore a separate feature of an embodiment to provide a method of driving an organic light emitting display that supplies scan signals having a same pulse width irrespective of a frame frequency and/or driving mode.

At least one of the above and other features and advantages may be realized by providing an organic light emitting display, including a mode determining unit adapted to determine whether the organic light emitting display is in a low power driving mode or a common driving mode based on an operation control signal and to generate a control signal corresponding to the determined mode, a scan driver adapted to sequentially supply scan signals to scan lines, a data driver adapted to supply data signals to data lines in synchronization with the scan signals, pixels arranged at intersections of the scan lines and the data lines, and a timing controller adapted to control the scan driver and the data driver so that a frame frequency changes based on whether the low power driving mode or the common driving mode control signal is supplied from the mode determining unit, wherein the scan driver is adapted to uniformly maintain a pulse width of the scan signals regardless of a change in the frame frequency.

The scan driver may be adapted to control a distance between a previously supplied scan signal and a scan signal to be currently supplied based on the change in the frame frequency.

The mode determining unit may be adapted to supply a low power control signal corresponding to the low power driving mode to the timing controller when the operation control signal is not supplied during a predetermined period of time and to supply a common control signal to the timing controller corresponding to the common driving mode at other times.

When the mode determining unit determines that the operation control signal has not been supplied during the predetermined period of time, the mode determining unit may additionally determine whether an image currently displayed is a still image or a moving picture, and may be adapted to supply the low power control signal to the timing controller only when the image is determined as the still image.

The timing controller may be adapted to control the scan driver and the data driver to be driven at a first frame frequency when the common driving mode control signal is supplied and to be driven at a second frame frequency when the low power driving mode control signal is supplied.

The first frame frequency may be higher than the second frame frequency.

The pixels may each include an organic light emitting diode (OLED), and a driving transistor adapted to control an amount of current supplied to the OLED.

Each of the pixels may further include a plurality of transistors and a storage capacitor adapted to compensate for a threshold voltage of the driving transistor.

At least one of the above and other features and advantages may be separately realized by providing a method of driving an organic light emitting display, including changing a frame frequency based on an externally supplied operation control signal, uniformly maintaining a pulse width of scan signals regardless of the frame frequency, and supplying data signals in synchronization with the scan signals.

Uniformly maintaining the width of scan signals regardless of the frame frequency may include controlling a time period between scan pulses of subsequent ones of the scan signals based on the frame frequency.

The driving method may further include controlling emission and non-emission states of emission control signals to be supplied to emission control lines based on the time periods between respective scan pulses.

Changing the frame frequency based on the externally supplied operation control signal may include determining whether the organic light emitting display is in a common driving mode or in a low power driving mode based on the operation control signal, and setting the frame frequency as a first frame frequency for the common driving mode and setting the frame frequency as a second frame frequency for the low power driving mode.

The first frame frequency may be higher than the second frame frequency.

Changing the frame frequency based on the externally supplied operation control signal may include determining that the organic light emitting display is in the low power mode when the operation control signal has not been input for a predetermined period of time.

Changing the frame frequency based on the externally supplied operation control signal may include determining that the operation control signal has not been input for a predetermined period of time, determining whether an image being displayed during the predetermined time is a still image or a moving picture, determining that the organic light emitting display is in the low power mode when the image displayed is determined to be a still image and when the operation control signal has not been input during the predetermined period of time, and determining that the organic light emitting display is in the common driving mode when the image displayed is determined to be a moving picture.

The method may further include generating light with predetermined brightness in pixels of the display based on the supplied data signals.

At least one of the above and other features and advantages may be realized by providing an organic light emitting display including a plurality of pixels, including a mode determining unit adapted to determine whether the organic light emitting display is in a first driving mode corresponding to a first frame frequency or a second driving mode corresponding to a second frame frequency based on an operation control signal and to generate a control signal corresponding to the determined mode, a scan driver; and a timing controller adapted to control the scan driver so that a frame frequency changes based on whether the display is in the first driving mode or the second driving mode, wherein the scan driver is adapted sequentially supply scan signals having a same pulse width to scan lines during the first driving mode and the second driving mode and a different, and wherein the scan driver is adapted to apply a first time period between the scan pulses of consecutively driven scan lines during the first driving mode and to apply a second time period between the scan pulses of consecutively driven scan lines during the second driving mode, the first time period being different from the second time period.

The first driving mode may be a common driving mode and the second driving mode may be a low power driving mode, and the first frame frequency may be faster than the second frame frequency.

The first time period may correspond to a time period between an ending edge of a $(n-1)^{th}$ scan pulse and a beginning edge of an $n^{th}$ scan pulse.

The scan driver may be further adapted to control emission and non-emission states of emission control lines based on whether the display is in the first driving mode or the second driving mode such that non-emission time of the emission control signals associated with the first driving mode is different from the non-emission time of the emission control signals associated with the second driving mode by an integer multiple of a difference in time between the first time period and the second time period.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
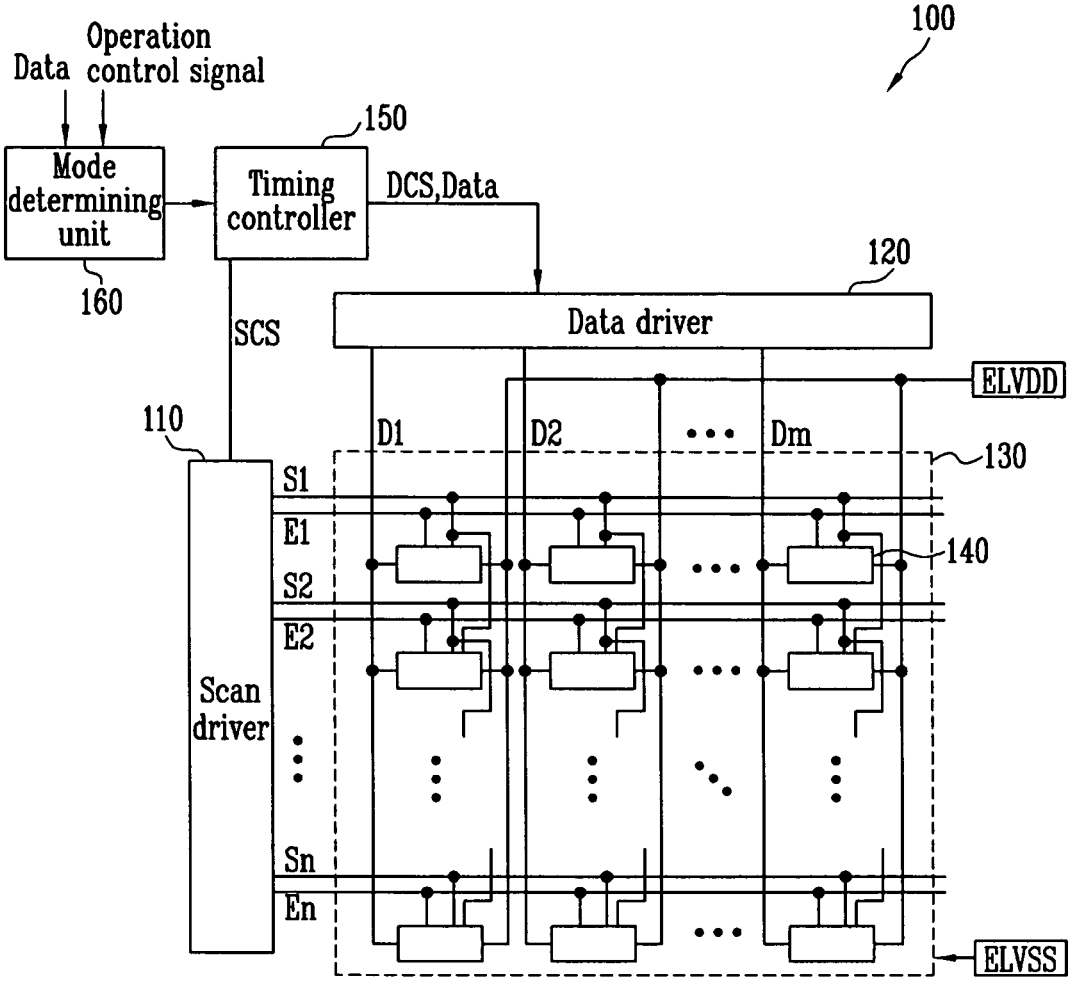
FIG. 1 illustrates a schematic diagram of an exemplary organic light emitting display.

Korean Patent Application No. 10-2009-0083930, filed on Sep. 7, 2009, in the Korean Intellectual Property Office, and entitled: "Organic Light Emitting Display and Driving Method Thereof" is incorporated by reference herein in its entirety.

Exemplary embodiments will now be described more fully hereinafter with reference to the accompanying drawings; however, aspects may be embodied in different forms and should not be construed as limited to the embodiments set forth herein. Rather, these embodiments are provided so that this disclosure will be thorough and complete, and will fully convey the scope of the invention to those skilled in the art.

In the following description, it will be understood that when a first element is described as being coupled to a second element, the first element may be directly coupled to the second element but may also be indirectly coupled to the second element via one or more other elements. Further, some of the elements that are not essential to the complete understanding of the invention are omitted for clarity. Also, like reference numerals refer to like elements throughout the specification.

FIG. 1 illustrates a schematic diagram of an exemplary organic light emitting display 100.

Referring to FIG. 1, the organic light emitting display 100 may include a pixel unit 130, including pixels 140 coupled to scan lines S1 to Sn and data lines D1 to Dm, a scan driver 110 for driving the scan lines S1 to Sn and emission control lines E1 to En, a data driver 120 for driving the data lines D1 to Dm, a timing controller 150 for controlling the scan driver 110 and the data driver 120, and a mode determining unit 160 for determining a driving mode.

The mode determining unit 160 may determine a driving mode based on an externally supplied operation control signal and may supply a control signal corresponding to the determined driving mode to the timing controller 150. The operation control signal may be, e.g., a signal input to a key board, movement of a mouse, etc.). Driving modes may include, e.g., a common driving mode, a low-power driving mode, etc. The mode determining unit 160 may also receive external data Data. The mode determining unit 160 may determine an image to be displayed by the pixel unit 130 and may determine the driving mode corresponding to the determined image.

For example, the mode determining unit 160 may determine that the display 100 is to be driven in a low power driving mode when an operation control signal, e.g., a signal input by a keyboard, has not been input during a predetermined period of time and may supply a low power control signal to the timing controller 150. Further, e.g., the mode determining unit 160 may determine that the display 100 is to be driven in a common driving mode when an operation control signal, e.g., has been input during the predetermined period of time, and may supply a common control signal to the timing controller 150.

More particularly, e.g., when an operation control signal has not been input during the predetermined period, the mode determining unit 160 may determine the image to be displayed by the pixel unit 130 based on externally supplied data Data. In some cases, e.g., when an operation control signal has not been input during the predetermined period, the image to be displayed may be a still image. In such cases, e.g., when the determined image is a still image, and it is determined that an operation control signal has not been input during the predetermined period, the mode determining unit 160 may supply the low power control signal to the timing controller 150. On the other hand, in some embodiments, if the mode determining unit 160 determines that the current image to be displayed is a moving picture, the mode determining unit 160 may supply the common control signal to the timing controller 150 even when it is determined that the operation control signal has not been input during the predetermined time.

The predetermined period of time during which it may determined whether an operation control signal has/has not been input, may be set based, e.g., on user preferences, default settings, etc. That is, embodiments are not limited to specific predetermined periods of time. For example, the predetermined period of time may be experimentally determined based on an environment in which a monitor is to be provided.

The timing controller 150 may generate data driving control signals DCS and scan driving control signals SCS based on externally supplied synchronizing signals/data Data. The data driving control signals DCS may be supplied to the data driver 120 and the scan driving control signals SCS may be supplied to the scan driver 110. The timing controller 150 may supply the externally supplied data Data to the data driver 120.

The timing controller 150 may supply a first frame control signal to the scan driver 110 and the data driver 120 when the common control signal is input. The timing controller 150 may supply a second frame control signal to the scan driver 110 and the data driver 120 when the low power control signal is input. The first frame control signal and the second frame control signal are included in the scan driving control signal SCS and the data driving control signal DCS.

The scan driver 110 may receive the scan driving control signals SCS from the timing controller 150. After receiving the scan driving control signals SCS, the scan driver 110 may generate scan signals and may sequentially supply the generated scan signals to the scan lines S1 to Sn. In addition, the scan driver 110 may generate emission control signals in response to the scan driving control signals SCS. The scan driver 110 may sequentially supply the generated emission control signals to the emission control lines E1 to En. A width of the emission control signals may be equal to or larger than a width of the scan signals.

Figure 2A:
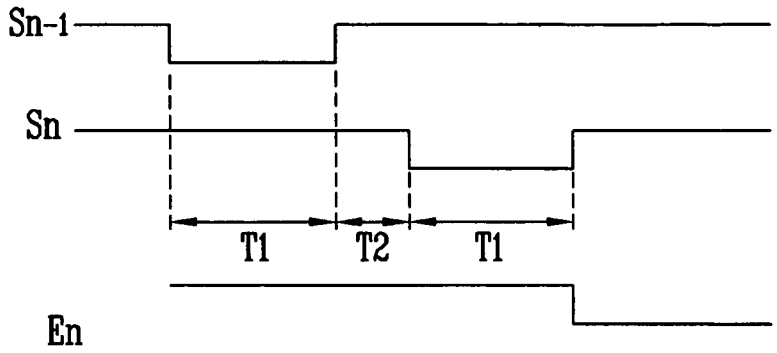
FIGS. 2A and 2B illustrate exemplary waveform diagrams of exemplary scan signals employable during a first driving mode having a first frame frequency and a second driving mode having a second frame frequency, respectively, for maintaining brightness and/or color characteristics of pixels being driven.
Figure 2B:
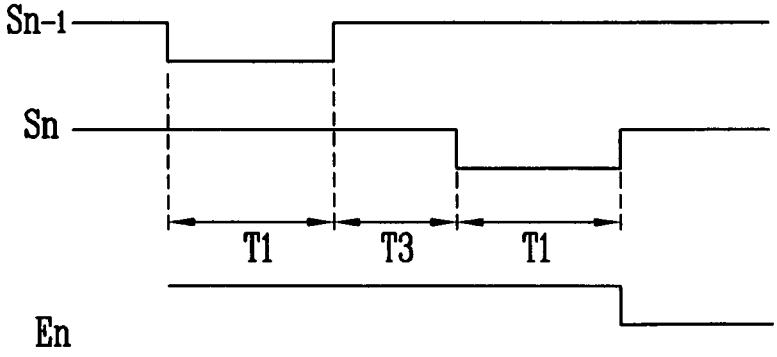

The scan driver 110 may control a distance or time period between scan pulses of sequentially applied ones the generated scan signals based on whether the first frame control signal or the second frame control signal was supplied to the scan driver 110. FIGS. 2A and 2B illustrate exemplary waveform diagrams of exemplary scan signals employable during a first driving mode having a first frame frequency, and a second driving mode having a second frame frequency, respectively. More particularly, FIG. 2A illustrates exemplary scan signals that may be supplied according to the first frame frequency, e.g., corresponding to the common driving mode when the common control signal may have been supplied to the scan driver 110, and FIG. 2B illustrates exemplary scan signals that may be supplied according to the second frame frequency, e.g., corresponding to a lower frequency of the low power driving mode when the low power control signal may have been supplied to the scan driver 110. For example, the first frame frequency during the common driving mode may be 60 Hz and the second frame frequency during the low power driving mode may be 40 Hz.

Referring to FIG. 2A, according to the first frame frequency, e.g., the scan driver 110 may respectively supply scan signals including pulses according to a first time period T1 to the scan lines S1 to Sn and a distance between an end of the scan pulse of scan signal of the $(n-1)^{th}$ scan line Sn−1 and a start of the scan pulse of the scan signal of the $n^{th}$ scan line Sn may correspond to a second time period T2. Referring to FIG. 2B, according to the second frame frequency, e.g., the scan driver may respectively supply scan signals including pulses according to the first time period T1 to the scan lines S1 to Sn and a distance between an end of the scan pulse of the scan signal of the $(n-1)^{th}$ scan line Sn−1 and a start of the scan pulse of the scan signal of the nth scan line Sn may correspond to a third time period T3.

As shown in FIGS. 2A and 2B, widths of the scan pulses may correspond to the first time period T1 irrespective of whether the first frame control signal or the second frame control signal was supplied to the scan driver 110. Thus, e.g., during the common driving mode and the low power driving mode, widths of the scan pulses of the respective scan signals applied to the scan lines S1-Sn may be the same. On the other hand, based on whether the first frame control signal or the second frame control signal was supplied to the scan driver 110, e.g., whether the pixel unit 130 is to be driven under the common driving mode or the low power driving mode, time periods between scan pulses of subsequent ones of the scan signals, e.g., the $(n-1)^{th}$ and $n^{th}$ scan signals, may be controlled to correspond to the second time period T2 for the first frame frequency and to correspond to the third time period T3 for the second frame frequency. In such embodiments, the second time period T2 may be different from, e.g., shorter than, the third time period T3. That is, e.g., in the low power mode, more time may elapse between scan pulses of subsequent ones of the scan signals in accordance with a slower frame frequency.

The scan driver 110 may control on/off times of the emission control signals based on the scan signals. More particularly, the scan driver 110 may control emission/non-emission time periods of the emission control signals based on the frame frequency. For example, with reference to FIG. 2A, in the exemplary case of two scan signals being supplied to the $(n-1)^{th}$ and $n^{th}$ scan lines S(n−1) and Sn, the scan driver 110 may controllably supply emission control signals that may overlap the first time period T1 of the scan pulse supplied to $(n-1)^{th}$ scan line S(n−1), the first time period T1 of the scan pulse supplied to the $n^{th}$ scan signal Sn, and the second time period T2 corresponding to the time between the respective pulses being driven according to the first frame frequency. Further, with reference to FIG. 2B, e.g., in the exemplary case of two scan signals being supplied to the $(n-1)^{th}$ and $n^{th}$ scan lines S(n−1) and Sn, the scan driver 110 may controllably supply emission control signals that may overlap the first time period T1 of the scan pulse supplied to $(n-1)^{th}$ scan line S(n−1), the first time period T1 of the scan pulse supplied to the $n^{th}$ scan signal Sn, and the third time period T3 corresponding to the time between the respective pulses being driven according to the second frame frequency. More particularly, referring to FIGS. 2A and 2B, the emission control signals supplied to the $n^{th}$ emission control line En may be "high" or in a "non-emission state" while the respective scan pulses are supplied to the $(n-1)^{th}$ and the $n^{th}$ scan lines S(n−1) and Sn as well as the second time period T2 (shown in FIG. 2A corresponding to the first frame frequency) or the third time period T3 (shown in FIG. 2B corresponding to the second frame frequency) lapsing between the two subsequent scan signals.

The scan driver 110 may supply scan signals including scan pulses having a first width corresponding to the first time period T1 regardless of a change in frame frequency. Accordingly, embodiments may enable storage capacitors included in pixels, e.g., the pixels 140 of FIG. 1, to have a uniform charge period irrespective of a change in frame frequency. Embodiments may be advantageous by enabling brightness and/or color characteristics of pixels to be desensitized at least to changes in frame frequency. That is, e.g., embodiments may enable brightness and/or color characteristics of pixels to be uniformly maintained at least irrespectively of changes in frame frequency.

The data driver 120 may receive the data driving control signals DCS from the timing controller 150. After receiving the data driving control signals DCS, the data driver 120 may generate data signals and supply the generated data signals to the data lines D1 to Dm in synchronization with the scan signals.

The pixel unit 130 may receive a voltage of a first external power source ELVDD and a voltage of a second external power source ELVSS and may supply the received first and second power source ELVDD and ELVSS voltages to the pixels 140. Using the received first and second power source ELVDD and ELVSS voltages, the pixels 140 may generate light components corresponding to the data signals. More particularly, e.g., the pixels 140 positioned along an $i^{th}$ (i is a natural number) horizontal line of a matrix pattern may initialize gate electrodes of driving transistors during a period where a respective scan signal is supplied to the $(i-1)^{th}$ scan line S(i−1) and may charge voltages corresponding to the data signals and the threshold voltages of the driving transistors during a period where the scan signal is supplied to the $i^{th}$ scan line Si.

As described above, embodiments may enable various types of pixel structures, e.g., pixel structures including a storage capacitor, all pixel structures that charge a voltages corresponding to respective data signals when respective scan signals are supplied, etc., to be desensitized at least to changes in frame frequency. That is, as described above, embodiments may enable various types of pixels structures, e.g., pixel structures including a storage capacitor, all pixel structures that charge a voltages corresponding to respective data signals when respective scan signals are supplied, etc., to uniformly maintain brightness and/or color characteristics thereof irrespectively of changes in frame frequency by maintaining a charge time of the storage capacitor associated therewith.

Figure 3:
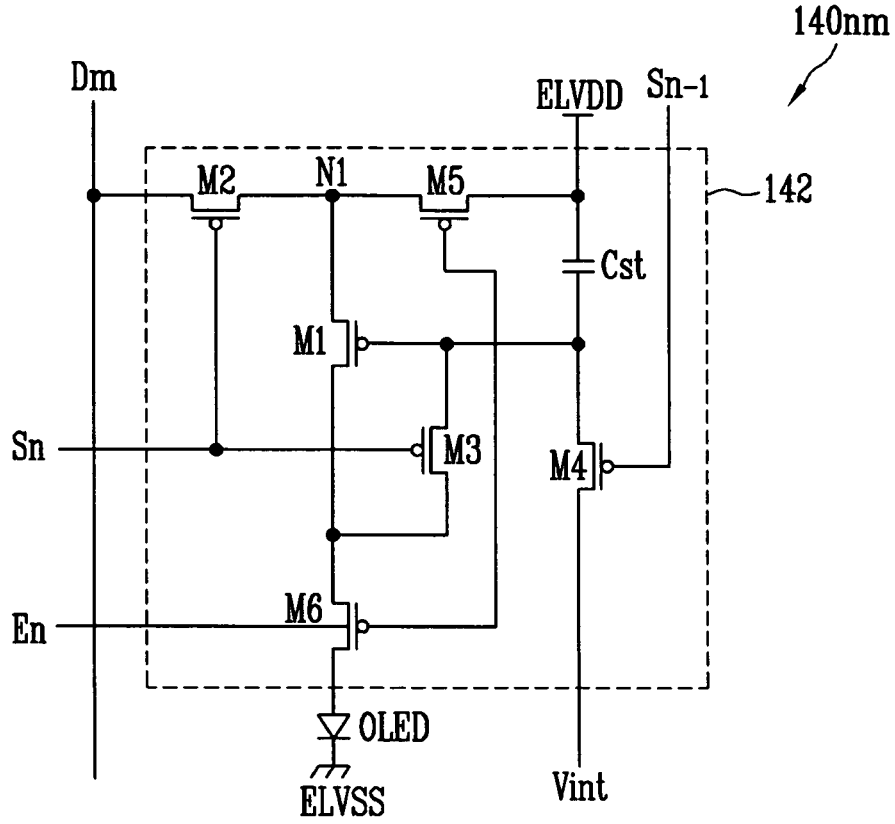
FIG. 3 illustrates a schematic diagram of an exemplary embodiment of a pixel structure employable with the display FIG. 1.

FIG. 3 illustrates a schematic diagram of an exemplary embodiment of a pixel 140*nm* employable with the display 100 FIG. 1 and with which one or more features described herein may be applied. It is understood by persons of ordinary skill in the art that the pixel structure of the pixels 140*nm* may be adapted to compensate for a threshold voltage of a driving transistor of the pixel.

For description purposes, the exemplary pixels 140*nm* illustrated in FIG. 3 is coupled to the $m^{th}$ data line Dm, the nth scan line Sn, the (n−1)th scan line Sn−1, and the nth emission control line En. Embodiments are not limited thereto. For example, the pixel 140*nm* of FIG. 3 may be used as one, some or all of the pixels 140 of the display 100 of FIG. 1.

Referring to FIG. 3, the pixel 140*nm* may include a pixel circuit 142 coupled to an OLED, the data line Dm, the scan lines Sn−1 and Sn, and the emission control line En. The pixel circuit 142 may control an amount of current supplied to the OLED.

An anode electrode of the OLED may be coupled to the pixel circuit 142 and a cathode electrode of the OLED may be coupled to the second power source ELVSS. A voltage value of the second power source ELVSS may be set to be lower than a voltage value of the first power source ELVDD. The OLED may generate light with predetermined brightness corresponding to an amount of current supplied from the pixel circuit 142.

The pixel circuit 142 may control the amount of current supplied to the OLED corresponding to the data signal supplied to the data line Dm when the scan signal is supplied to the scan line Sn. More particularly, e.g., the pixel circuit 142 may includes first to sixth transistors M1 to M6 and a storage capacitor Cst.

A first electrode of the second transistor M2 may be coupled to the data line Dm and the second electrode of the second transistor M2 may be coupled to a first node N1. A gate electrode of the second transistor M2 may be coupled to the $n^{th}$ scan line Sn. The second transistor M2 may be turned on when the scan signal is supplied to the $n^{th}$ scan line Sn and, when the second transistor M2 is turned on, it may enable the data signal supplied to the data line Dm to be supplied the first node N1.

A first electrode of the first transistor M1 may be coupled to the first node N1 and a second electrode of the first transistor M1 may be coupled to the first electrode of the sixth transistor M6. A gate electrode of the first transistor M1 may be coupled to a first terminal of the storage capacitor Cst. The first transistor M1 may supply a current corresponding to a voltage charged in the storage capacitor Cst to the OLED.

A first electrode of the third transistor M3 may be coupled to the second electrode of the first transistor M1 and a second electrode of the third transistor M3 may be coupled to the gate electrode of the first transistor M1. A gate electrode of the third transistor M3 may be coupled to the nth scan line Sn. The third transistor M3 may be turned on when the scan signal is supplied to the nth scan line Sn, and, when the third transistor M3 is turned on, may cause the first transistor M1 to be in a diode-connected state.

A gate electrode of the fourth transistor M4 may be coupled to the (n−1)th scan line Sn−1 and a first electrode of the fourth transistor M4 may coupled to the first terminal of the storage capacitor Cst and the gate electrode of the first transistor M1. A second electrode of the fourth transistor M4 may be coupled to an initialization power source Vint. The fourth transistor M4 may be turned on when the scan signal is supplied to the $(n-1)^{th}$ scan line Sn−1 and, when the fourth transistor M4 is turned on, a voltage of the first terminal of the storage capacitor Cst and the gate electrode of the first transistor M1 may change corresponding to the voltage of the initialization power source Vint.

A first electrode of the fifth transistor M5 may be coupled to the first power source ELVDD and the second electrode of the fifth transistor M5 may be coupled to the first node N1. A gate electrode of the fifth transistor M5 may be coupled to the emission control line En. The fifth transistor M5 may be turned on when the emission control signal is not supplied, e.g., in a non-emission state, from the emission control line En so that the first power source ELVDD may be electrically coupled to the first node N1.

A first electrode of the sixth transistor M6 may be coupled to the second electrode of the first transistor M1 and a second electrode of the sixth transistor M6 may be coupled to the anode electrode of the OLED. A gate electrode of the sixth transistor M6 may be coupled to the emission control line En. The sixth transistor M6 may be turned on when the emission control signal is not supplied, e.g., non-emission state, to supply the current supplied from the first transistor M1 to the OLED.

Figure 4:
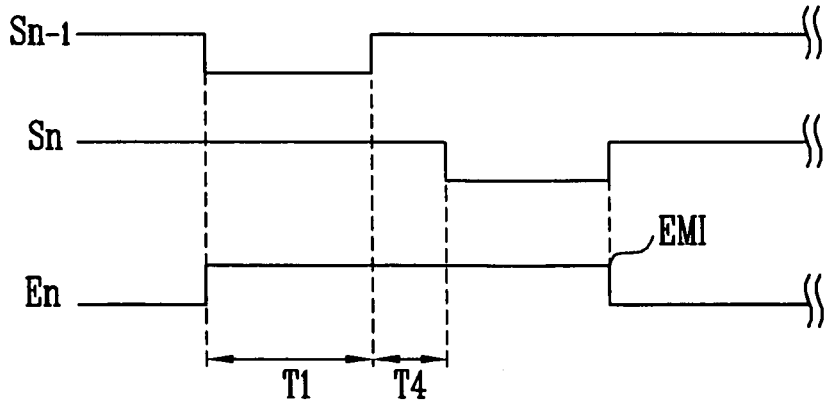
FIG. 4 illustrates an exemplary waveform diagram of signals employable by an exemplary embodiment of a method of driving a pixel.

FIG. 4 illustrates an exemplary waveform diagram of signals employable by an exemplary embodiment of a method of driving the pixel 140*nm* of FIG. 3.

Referring to FIGS. 3 and 4, first, the scan signal may be supplied to the $(n-1)^{th}$ scan line Sn−1 so that the fourth transistor M4 may be turned on. When the fourth transistor M4 is turned on, a voltage of the initialization power source Vint may be supplied to the first terminal of the storage capacitor Cst and the gate terminal of the first transistor M1. That is, when the fourth transistor M4 is turned on, the voltages at the first terminal of the storage capacitor C and the gate terminal of the first transistor M1 may be initialized to the voltage of the initialization power source Vint. The voltage value of the initialization power source Vint may be set to be smaller than the voltage value of the data signal.

Then, the scan signal may be supplied to the $n^{th}$ scan line Sn. When the scan signal is supplied to the $n^{th}$ scan line Sn, the second transistor M2 and the third transistor M3 may be turned on. When the third transistor M3 is turned on, the first transistor M1 may be coupled in the form of a diode. When the second transistor M2 is turned on, the data signal supplied to the data line Dm may be supplied to the first node N1 via the second transistor M2. At this time, because the voltage of the gate terminal of first transistor M1 may be set at the voltage of the initialization power source Vint (that is, set to be smaller than the voltage of the data signal supplied to the first node N1), the first transistor M1 may be turned on.

When the first transistor M1 is turned on, the data signal applied to the first node N1 may be supplied to the first terminal of the storage capacitor Cst via the first transistor M1 and the third transistor M3. Since the data signal is supplied to the storage capacitor Cst via the first transistor M1 in the diode-connected state, the data signal and the voltage corresponding to the threshold voltage of the first transistor M1 may be charged in the storage capacitor Cst.

After the voltages corresponding to the data signal and the threshold voltage of the first transistor M1 are charged in the storage capacitor Cst, the emission control signals EMI may be changed from a non-emission state, e.g., high level, to an emission state, e.g., low level, so that the fifth transistor M5 and the sixth transistor M6 may be turned on. When the fifth transistor M5 and the sixth transistor M6 are turned on, a current path from the first power source ELVDD to the OLED is formed. In this case, the first transistor M1 may control an amount of current that flows from the first power source ELVDD to the OLED corresponding to the voltage charged in the storage capacitor Cst.

Here, since the voltage corresponding to the threshold voltage of the first transistor M1 as well as the data signal may be additionally charged in the storage capacitor Cst included in the pixel 140, an amount of current that flows to the OLED may be controlled regardless of the threshold voltage of the first transistor M1.

More importantly, in the driving waveforms of FIG. 4, for driving of the pixel 140*nm* according to any frame frequency, e.g., a first frame frequency, second frame frequency, etc., only a time period T4 between scan pulses of subsequent scan signals, e.g., scan signals applied to the $(n-1)^{th}$ and the $n^{th}$ scan lines S(n−1), may be changed based on a frame frequency of a current driving mode. That is, in embodiments, irrespective of a frame frequency of a current driving mode, a time period T1 corresponding to a pulse width of respective scan signals may remain constant. More particularly, in embodiments, irrespective of a frame frequency of a current driving mode, a charge time of a storage capacitor Cst may remain constant. Referring to TABLE 1, an effect on brightness corresponding to a change in a width of a scan pulse of a scan signal, as applied to the pixel 140*nm* of FIG. 3.

TABLE 1

| | Frame Frequency | | |
|---|---|---|---|
| | 60 Hz | 40 Hz | 60 Hz |
| Width (μs) of Scan Signal | 26 | 39 | 26 |
| Brightness (cd/m$^2$) | 560 | 525 | 561 |

Referring to TABLE 1, when the width of the scan pulse corresponding to the time T1 is changed, i.e., not maintained as constant, based on a respective frame frequency, the brightness changes. More particularly, when the width of the scan pulse is changed from 26 μs for a frame frequency of 60 Hz to 39 μs for a frame frequency of 40 Hz, the brightness changes from about 560 cd/m$^2$ to about 525 cd/m$^2$. Thus, in such cases, a charge time of the storage capacitor changes corresponding to the change in the pulse width of the scan signals such that the brightness changes.

As described above, however, embodiments may be advantageous by providing an organic light emitting display and/or a driving method for driving an organic light emitting display that may maintain a time period of scan pulses at a predetermined constant irrespective of a frame frequency and/or driving mode. Embodiments may separately enable a charge time of a storage capacitor of a pixel to be maintained constant irrespective of a frame frequency and/or driving mode. Embodiments may separately enable brightness and/or color characteristics of pixels to be desensitized to changes in frame frequency and/or driving modes, e.g., brightness and/or color characteristics may be uniformly maintained irrespective of frame frequency.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a mode determiner adapted to determine whether the organic light emitting display is in a low power driving mode or a common driving mode based on an operation control signal and to generate a control signal corresponding to the determined mode;

a scan driver adapted to sequentially supply a first scan signal and a second scan signal to corresponding scan lines coupled to respective pixels of the organic light emitting display;

a data driver adapted to supply data signals to data lines in synchronization with the scan signals;

pixels arranged at intersections of the scan lines and the data lines; and a timing controller adapted to control the scan driver and the data driver so that a frame frequency changes based on whether the low power driving mode or the common driving mode control signal is supplied from the mode determiner, wherein the scan driver is adapted to maintain a substantially uniform pulse width of the scan signals regardless of a change in the frame frequency by controlling a distance between an end of the first scan signal and a start of the second scan signal to be supplied through the corresponding scan lines based on the change in the frame frequency.

2. The organic light emitting display as claimed in claim 1, wherein the mode determiner is adapted to supply a low power control signal corresponding to the low power driving mode to the timing controller when the operation control signal is not supplied during a predetermined period of time and to supply a common control signal to the timing controller corresponding to the common driving mode at other times.

3. The organic light emitting display as claimed in claim 2, wherein, when the mode determiner determines that the operation control signal has not been supplied during the predetermined period of time, the mode determiner additionally determines whether an image currently displayed is a still image or a moving picture, and is adapted to supply the low power control signal to the timing controller only when the image is determined as the still image.

4. The organic light emitting display as claimed in claim 1, wherein the timing controller is adapted to control the scan driver and the data driver to be driven at a first frame frequency when the common driving mode control signal is supplied and to be driven at a second frame frequency when the low power driving mode control signal is supplied.

5. The organic light emitting display as claimed in claim 4, wherein the first frame frequency is higher than the second frame frequency.

6. The organic light emitting display as claimed in claim 1, wherein each of the pixels comprises:

an organic light emitting diode (OLED); and a driving transistor adapted to control an amount of current supplied to the OLED.

7. The organic light emitting display as claimed in claim 6, wherein each of the pixels further comprises a plurality of transistors and a storage capacitor adapted to compensate for a threshold voltage of the driving transistor.

8. The organic light emitting display as claimed in claim 1, wherein:

the scan driver is to generate a first scan signal for a first scan line and a second scan signal for a second scan line within a same frame, the first scan signal and the second scan signal separated by a time period, the time period having a first duration for the common driving mode and a second duration for the low power driving mode, the first duration different from the second duration, and the scan driver is adapted to maintain the substantially uniform pulse width of the scan signals regardless of whether the time period has the first duration or the second duration.

9. The organic light emitting display as claimed in claim 1, wherein a pulse width of the first scan signal and a pulse width of the second scan signal are maintained to be substantially the same with each other by controlling a distance between an end of the first scan signal and a start of the second scan signal based on the change in the frame frequency.

10. The organic light emitting display as claimed in claim 1, wherein the corresponding scan lines are adjacent to each other.

11. A method of driving an organic light emitting display, comprising:

changing a frame frequency based on an externally supplied operation control signal;

maintaining a substantially uniform pulse width of a first scan signal and a second scan signal to be applied to respective pixels of the organic light emitting display regardless of the frame frequency by controlling a time period between an end of the first scan signal and a start of the second scan signal to be supplied through corresponding scan lines based on the change in the frame frequency; and supplying data signals in synchronization with the scan signals.

12. The method as claimed in claim 11, further comprising:

controlling emission and non-emission states of emission control signals to be supplied to emission control lines based on the time periods between respective scan pulses.

13. The method as claimed in claim 11, wherein changing the frame frequency based on the externally supplied operation control signal includes:

determining whether the organic light emitting display is in a common driving mode or in a low power driving mode based on the operation control signal; and setting the frame frequency as a first frame frequency for the common driving mode and setting the frame frequency as a second frame frequency for the low power driving mode.

14. The method as claimed in claim 13, wherein the first frame frequency is higher than the second frame frequency.

15. The method as claimed in claim 13, wherein changing the frame frequency based on the externally supplied operation control signal includes:

determining that the organic light emitting display is in the low power mode when the operation control signal has not been input for a predetermined period of time.

16. The method as claimed in claim 13, changing the frame frequency based on the externally supplied operation control signal includes:

determining that the operation control signal has not been input for a predetermined period of time, determining whether an image being displayed during the predetermined time is a still image or a moving picture, determining that the organic light emitting display is in the low power mode when the image displayed is determined to be a still image and when the operation control signal has not been input during the predetermined period of time, and determining that the organic light emitting display is in the common driving mode when the image displayed is determined to be a moving picture.

17. The method as claimed in claim 11, further comprising generating light with predetermined brightness in pixels of the display based on the supplied data signals.

18. An apparatus for controlling a display panel, comprising:

an identifier to identify a mode of the display panel; and a driver to generate control signals for driving the display panel based on the mode identified by the identifier, wherein the driver generates a first control signal for a first line and a second control signal for a second line within a same frame, and maintains a substantially uniform pulse width of the first and second control signals regardless of a change in the frame frequency by controlling a distance between an end of the first control signal and a start of the second control signals to be supplied though the first line and the second line, respectively, based on the change in the frame frequency, the first control signal and the second control signal separated by a time period, the time period having a first duration for a first mode of the display panel and a second duration for a second mode of the display panel, the first duration different from the second duration.

19. The apparatus of claim 18, wherein:

the first duration corresponds to a first power mode; and the second duration corresponds to a second power mode different from the first power mode.

20. The apparatus of claim 19, wherein:

the first duration is greater than the second duration, and the second power mode is a lower power mode than the first power mode.

21. The apparatus of claim 20, wherein:

the driver operates at a first frequency in the first power mode;

the driver operates at a second frequency in the second power mode; and the first frequency is different from the second frequency.

22. The apparatus of claim 18, wherein the first line is adjacent to the second line.

23. The apparatus of claim 18, wherein:

the first and second lines are scan lines; and a width of the first control signal is substantially equal to the width of the second control signal for the first mode and the second mode.

* * * * *